US011493044B2

(12) United States Patent
Kim et al.

(10) Patent No.: US 11,493,044 B2
(45) Date of Patent: Nov. 8, 2022

(54) ROTARY COMPRESSOR WITH A VANE DISCHARGE-SIDED GROOVE AND A VANE SUCTION-SIDED GROOVE

(71) Applicant: LG Electronics Inc., Seoul (KR)

(72) Inventors: Ki Sun Kim, Seoul (KR); Sangha Lee, Seoul (KR); Jaeyeol Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 167 days.

(21) Appl. No.: 16/931,163

(22) Filed: Jul. 16, 2020

(65) Prior Publication Data

US 2021/0017984 A1 Jan. 21, 2021

(30) Foreign Application Priority Data

Jul. 17, 2019 (KR) ..... 10-2019-0086566

(51) Int. Cl.
*F04C 18/324* (2006.01)
*F01C 21/08* (2006.01)
*F04C 29/12* (2006.01)

(52) U.S. Cl.
CPC ..... *F04C 18/324* (2013.01); *F01C 21/0809* (2013.01); *F04C 29/12* (2013.01)

(58) Field of Classification Search
CPC ..... F04C 18/324; F04C 29/12; F01C 21/0809
See application file for complete search history.

(56) References Cited

U.S. PATENT DOCUMENTS

2017/0275996 A1 9/2017 Cho et al.

FOREIGN PATENT DOCUMENTS

| | | | | |
|---|---|---|---|---|
| EP | 2418386 | | 2/2012 | |
| EP | 2418386 | | 12/2017 | |
| EP | 3741958 | A1 * | 11/2020 | ..... F01C 21/102 |
| JP | H09137785 | | 5/1997 | |
| JP | 2011052592 | | 3/2011 | |
| JP | 2011052592 | A * | 3/2011 | |
| KR | 1020160034071 | | 3/2016 | |

OTHER PUBLICATIONS

Extended European Search Report in European Appln. No. 20185904.8, dated Nov. 26, 2020, 6 pages.
Korean Office Action in Korean Appln. No. 10-2019-0086566, dated Sep. 22, 2020, 15 pages (with English translation).

* cited by examiner

*Primary Examiner* — Mary Davis
(74) *Attorney, Agent, or Firm* — Fish & Richardson P.C.

(57) ABSTRACT

A rotary compressor includes a cylinder having a vane slot and a compression chamber, a shaft having an eccentric portion and configured to perpendicularly pass through a center of the compression chamber, a roller having a coupling groove and configured to orbit in the compression chamber by rotation of the shaft, and a vane having a vane hinge coupled to the coupling groove and a vane body being inserted into the vane slot and configured to divide the compression chamber into a discharge space and a suction space. A shape of the discharge-sided groove close to the discharge space and a shape of the suction-sided groove close to the suction space are asymmetrically formed between the vane hinge and the vane body with respect to the a central axis of the vane.

20 Claims, 12 Drawing Sheets

ROTARY COMPRESSOR WITH A VANE DISCHARGE-SIDED GROOVE AND A VANE SUCTION-SIDED GROOVE

CROSS-REFERENCE TO RELATED APPLICATION

This application claims priority to and the benefit of Korean Patent Application No. 10-2019-0086566, filed in Korea on, Jul. 17, 2019, the disclosure of which is incorporated herein by reference in its entirety.

TECHNICAL FIELD

A rotary compressor is disclosed herein.

BACKGROUND

In rotary compressors, a vane inserted into and installed in a cylinder makes linear movements while a roller makes orbital movements in the cylinder. Accordingly, a suction chamber and a discharge chamber form a compression chamber the volume of which is variable, such that refrigerants are suctioned, compressed and discharged.

The rotary compressors can be classified as a combined one and a non-combined one on the basis of whether the roller and the vane are coupled or not.

As a related art, a combined rotary compressor in which a vane and a roller are coupled as described above is disclosed in European Patent No. 2418386.

FIG. 1 is a view illustrating a compression portion of a combined rotary compressor of the related art, and FIG. 2 is an enlarged view illustrating the concave portion in FIG. 1.

Referring to FIGS. 1 and 2, the combined rotary compressor of the related art includes a cylinder 30, a roller 32 and a vane 33.

The cylinder 30 is provided with a compression chamber 39 at a central portion thereof, and provided with a vane slot 30*b*, a suction portion 40 into which refrigerants are suctioned and a discharge portion 38, from which refrigerants are discharged, at one side thereof.

The roller 32 has a ring shape, and an inner circumferential surface of the roller 32 is coupled to an eccentric portion of a rotational shaft 31 such that the roller 32 orbits in the compression chamber 39.

For the vane 33, a hinge 33*a* formed at a front end is coupled to one side of an outer circumferential surface of the roller 32, and a rear end is inserted into the vane slot 30*b* and reciprocates linearly because of orbital movements of the roller 32.

A central axis (Pb) of the vane hinge 33*a*, as illustrated in FIG. 2, is spaced apart from a central axis (Pa) of the vane 33 or the compression chamber 39 towards the relatively high-pressure discharge portion 38 in parallel with the central axis (Pa).

For the vane slot 30*b*, a rear end near an outer circumferential surface of the cylinder 30 is inclined towards the discharge portion 38 with respect to a front end near the roller 32.

The vane 33 is asymmetrically formed with respect to the central axis (Pa).

Specifically, for the vane 33, volume of a contraction portion 33*g* close to the relatively high-pressure discharge portion 38 is smaller than volume of a contraction portion 33*f* close to a relatively low-pressure suction portion 40 with respect to the central axis (Pa).

That is, when the vane 33 is at a top dead point, volume (Vg) of a space formed among the contraction portion 33*g* close to the relatively high-pressure discharge portion 38, the roller 32 and the cylinder 30 is smaller than volume (Vf) of a space formed among the contraction portion 33*f* close to the relatively low-pressure suction portion 40, the roller 32 and the cylinder 30.

When the vane 33 is at the top dead point, the volume (Vg) of the space, formed among the contraction portion 33*g* close to the relatively high-pressure discharge portion 38, the roller 32 and the cylinder 30, is dead volume. Refrigerants in the compression chamber 39 remain in the dead volume (Vg), and the remaining refrigerants are suctioned into the suction portion 40 because of orbital movements of the roller 32, thereby causing loss of cooling capability.

The rotary compressor of the related art can reduce dead volume and loss of cooling capability, thereby ensuring improvement in compression efficiency.

However, in the rotary compressor of the related art, the central axis (Pb) of the vane hinge 33*a* is spaced apart from the central axis (Pa) of the vane 33 towards the relatively high-pressure discharge portion 38 in parallel with the central axis (Pa), thereby causing a deterioration of durability of the vane 33.

As a central axis of orbital movements of the roller 32 and the central axis (Pa) of the vane 33 are not aligned, a rotational force load caused by the roller 32 is greatly generated at the front end of the vane 33, thereby causing damage to the contraction portions 33*g*, 33*f* having a relatively low strength.

Thus, in a rotary compressor where a vane and a roller are coupled, dead volume needs to be reduced and a structure needs to be improved to enhance durability.

SUMMARY

The present disclosure is directed to a rotary compressor that may have an improved structure to minimize a load applied to a vane in a rotary compressor where a roller and a vane are coupled.

The present disclosure is also directed to a rotary compressor that may have an improved structure to reduce dead volume in a direction of a discharge space and to minimize inflow of remaining refrigerants in a compression chamber to a suction portion, caused by orbital movements of a roller.

The present disclosure is characterized in that a load applied to a vane is minimized thanks to a structure and shape of a coupling of a roller and a vane.

Particular implementations of the present disclosure provide a rotary compressor that includes a cylinder, a shaft, a roller, and a vane. The cylinder may include a vane slot and define a compression chamber. The shaft may include an eccentric portion and extend through a center of the compression chamber. The roller may include a coupling groove and be configured to orbit in the compression chamber based on rotation of the shaft. The vane may include a vane hinge and a vane body. The vane hinge may be configured to engage with the coupling groove and the vane body may be at least partially inserted into the vane slot to divide the compression chamber into a discharge space and a suction space. The vane may include a discharge-sided groove and a suction-sided groove that are disposed between the vane hinge and the vane body and that are opposite to each other with respect to a central axis of the vane. The discharge-sided groove may be closer to the discharge space than the suction-sided groove. The suction-sided groove may be closer to the suction space than the discharge-sided groove.

A central point of the coupling groove and a central axis of the compression chamber may be on a single straight line. A shape of the discharge-sided groove may be asymmetrical to a shape of the suction-sided groove with respect to the central axis of the vane.

In some implementations, the rotary compressor may optionally include one or more of the following features. The center of the compression chamber may be aligned with a center of the shaft. The coupling groove may include a circumference portion, a discharge-sided circular arc portion, and a suction-sided circular arc portion. The discharge-side circular arc portion may be symmetrical to the suction-sided circular arc portion with respect to a straight line that extends through a center of the circumference portion and the center of the compression chamber. A central axis of the vane slot may incline towards the suction space with respect to a first straight line that extends through a center of the coupling groove and the center of the compression chamber. The central axis of the vane slot may cross the first straight line. The central axis of the vane slot may cross the first straight line at the center of the coupling groove. An angle between the central axis of the vane slot and the first straight line may be within a range of 2° to 10°. A central axis of the vane slot may be aligned to the central axis of the vane. A center of the vane hinge may be aligned to a center of the coupling groove. A diameter of the vane hinge may be the same as a distance between opposite lateral surfaces of the vane body. The central axis of the vane may extend through a center of the vane hinge. A radius of curvature of the discharge-sided groove may be smaller than a radius of curvature of the suction-sided groove. A distance between the central axis of the vane and a center of the discharge-sided groove may be greater than a distance between the central axis of the vane and a center of the suction-sided groove. A distance from a first straight line that extends through a center of the vane hinge and is perpendicular to the central axis of the vane to a second straight line that extends through a center of the discharge-sided groove and is perpendicular to the central axis of the vane may be shorter than a distance from the first straight line to a third straight line that extends through a center of the suction-sided groove and is perpendicular to the central axis of the vane. Based on the vane being at a top dead point, a first space that is defined by the discharge-sided groove of the vane, the discharge-sided circular arc portion of the coupling groove, and the cylinder may be smaller than a second space that is defined by the suction-sided groove of the vane, the suction-sided circular arc portion of the coupling groove, and the cylinder. A volume of the first space may be 30 to 80% of a volume of the second space. The cylinder may include (i) a suction port that is defined at a side of the suction space, and (ii) a discharge hole that is defined at a side of the discharge space. The discharge hole may be configured to, based on the vane being at a top dead point, fluidly communicate with a space that is defined by the discharge-sided groove of the vane, the discharge-sided circular arc portion of the coupling groove, and the cylinder. A longest distance between the vane hinge and the vane body at the suction-sided groove along the central axis of the vane may be greater than a longest distance between the vane hinge and the vane body at the discharge-sided groove along the central axis of the vane. A depth from a suction-sided lateral surface of the vane body to the suction-sided groove may be greater than a depth from a discharge-sided lateral surface of the vane body to the discharge-sided groove. The discharge-sided lateral surface may be opposite to the suction-sided lateral surface with respect to the central axis of the vane.

A rotary compressor according to the present disclosure may comprise a cylinder provided with a vane slot at one side thereof and a compression chamber at a central portion thereof, a shaft provided with an eccentric portion and configured to perpendicularly pass through a center of the compression chamber, a roller having a ring shape, provided with a coupling groove at one side of an outer circumferential surface thereof and configured to make orbital movements in the compression chamber by rotation of the shaft, and a vane provided with a vane hinge having a circular arc shape and coupled to the coupling groove, and provided with a vane body one side of which is inserted into the vane slot and which is configured to divide the compression chamber into a discharge space and a suction space.

A central point of the coupling groove and a central axis of the compression chamber may be disposed on a single straight line.

A shape of a discharge-sided groove close to the discharge space and a shape of a suction-sided groove close to the suction space may be asymmetrically formed between the vane hinge and the vane body with respect to a central axis of the vane.

A center of the compression chamber and a center of the shaft may be on the same perpendicular line.

The coupling groove may comprise a discharge-sided circular arc portion and a suction-sided circular arc portion that are symmetrically formed with respect to a straight line passing a center of a circumference portion and a central axis of the compression chamber.

A center of the coupling groove may be the same as a center of the circumference portion.

The rotary compressor according to the present disclosure is characterized in that a load applied to the vane is minimized thanks to a shape of the vane slot.

The vane slot may be inclined towards a suction space with respect to the center of the coupling groove.

A central axis of the vane slot and a central axis of the compression chamber may be crossed at the central point of the coupling groove.

An angle formed between the central axis of the vane slot and the central axis of the compression chamber may be 2 to 10°.

The central axis of the vane slot may be the same as the central axis of the vane.

A central point of the vane hinge may be the same as a central point of the coupling groove.

A diameter of the vane hinge may be the same as a distance between both lateral surfaces of the vane body.

The central axis of the vane and the central axis of the compression chamber may be crossed at any one point.

The rotary compressor according to the present disclosure is characterize din that dead volume is minimized on the basis of a shape of the vane and that loss of cooling capability is minimized.

A radius of curvature of the discharge-sided groove may be smaller than a radius of curvature of the suction-sided groove.

A distance from the central axis of the vane to a center of the discharge-sided groove may be longer than a distance from the central axis of the vane to a center of the suction-sided groove.

A distance from a straight line, passing a center of the vane hinge and perpendicularly crossing the central axis of the vane, to the center of the discharge-sided groove may be shorter than a distance from the straight line to the center of the suction-sided groove.

A distance from the central axis of the vane to a curved region of the discharge-sided groove may be longer than a distance from the central axis of the vane to a curved region of the suction-sided groove.

A distance from the straight line, passing the center of the vane hinge and perpendicularly crossing the central axis of the vane, to the curved region of the discharge-sided groove may be shorter than a distance from the straight line to the curved region of the suction-sided groove.

When the vane is at a top dead point, volume of a space, formed among the discharge-sided groove, the discharge-sided circular arc portion and the cylinder, may be 30 to 80% of volume of a space formed among the suction-sided groove, the suction-sided circular arc portion and the cylinder.

The cylinder may comprise a suction port formed at one side of the suction space, and a discharge hole formed at one side of the discharge space.

When the vane is at the top dead point, the cylinder may comprise a discharge hole configured to communicate with a space formed among the discharge-sided groove, the discharge-sided circular arc portion and the cylinder.

A longest distance between the vane hinge and the vane body at the suction-sided groove may be longer than a longest distance between the vane hinge and the vane body at the discharge-sided groove, with respect to a length-wise direction of the vane.

A depth from a suction-sided lateral surface of the vane body to the suction-sided groove may be deeper than a depth from a discharge-sided lateral surface of the vane body to the discharge-sided groove.

A rotary compressor according to the present disclosure may minimize a load applied to a vane in a combined rotary compressor where a roller and a vane are coupled, thereby ensuring improvement in durability of the vane.

The rotary compressor may reduce dead volume at a discharge space and may reduce loss of cooling capability, caused by over compression, thereby ensuring improvement in cooling capability.

BRIEF DESCRIPTION OF THE DRAWINGS

The accompanying drawings constitute a part of this specification, illustrate one or more embodiments of the present disclosure, and together with the specification, explain the present disclosure, wherein.

DETAILED DESCRIPTION

Figure 1:
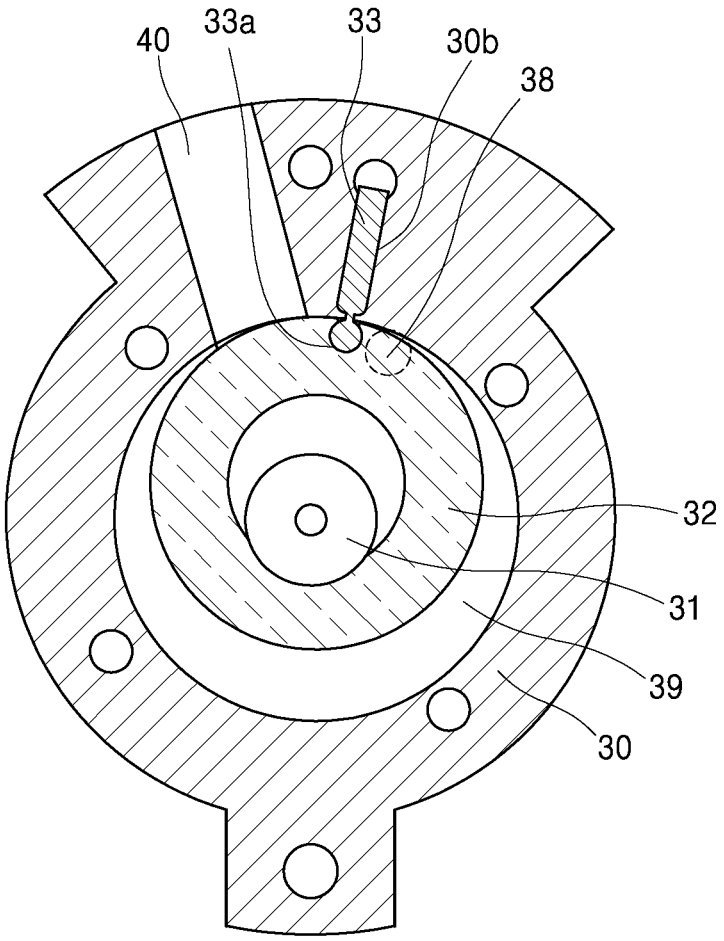
FIG. 1 PRIOR ART
FIG. 1 is a view illustrating a compression portion of a combined rotary compressor of the related art.
Figure 2:
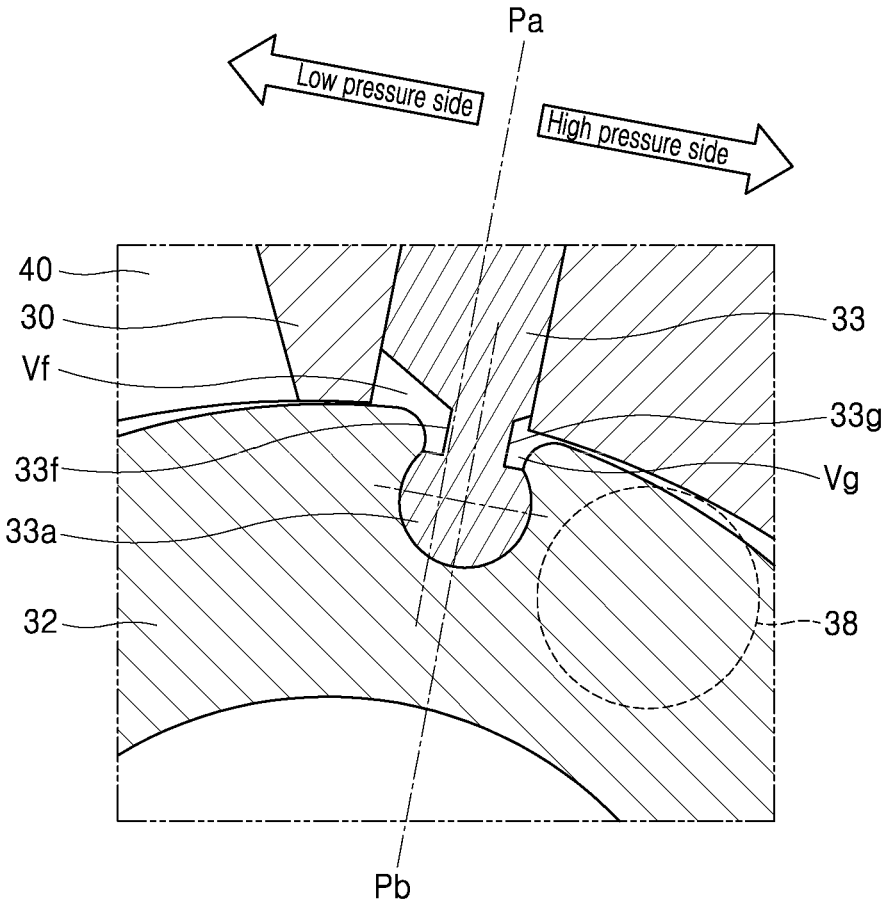
FIG. 2 PRIOR ART
FIG. 2 is an enlarged view illustrating the concave portion in FIG. 1.

The above-described aspects, features and advantages are specifically described with reference to the accompanying drawings hereunder such that one having ordinary skill in the art to which the present disclosure pertains may easily implement the technical spirit of the disclosure. During description in the disclosure, detailed description of relevant technologies is omitted if it is deemed to make the gist of the present disclosure unnecessarily vague. Below, preferred embodiments according to the disclosure are described with reference to the accompanying drawings. Throughout the drawings, identical reference numerals denote identical or similar components.

When any component is described as being "at an upper portion (or a lower portion) of a component" or "on (or under)" a component, any component may be placed on the upper surface (or the lower surface) of the component, and an additional component may be interposed between the component and any component placed on (or under) the component.

In describing components of the disclosure, when any one component is described as being "connected," "coupled" or "connected" to another component, any component may be directly connected or may be able to be directly connected to another component; however, it is also to be understood that an additional component may be "interposed" between the two components, or the two components may be "connected", "coupled" or "connected" through an additional component.

Below, a rotary compressor according to the present disclosure is described with reference to embodiments.

Figure 3:
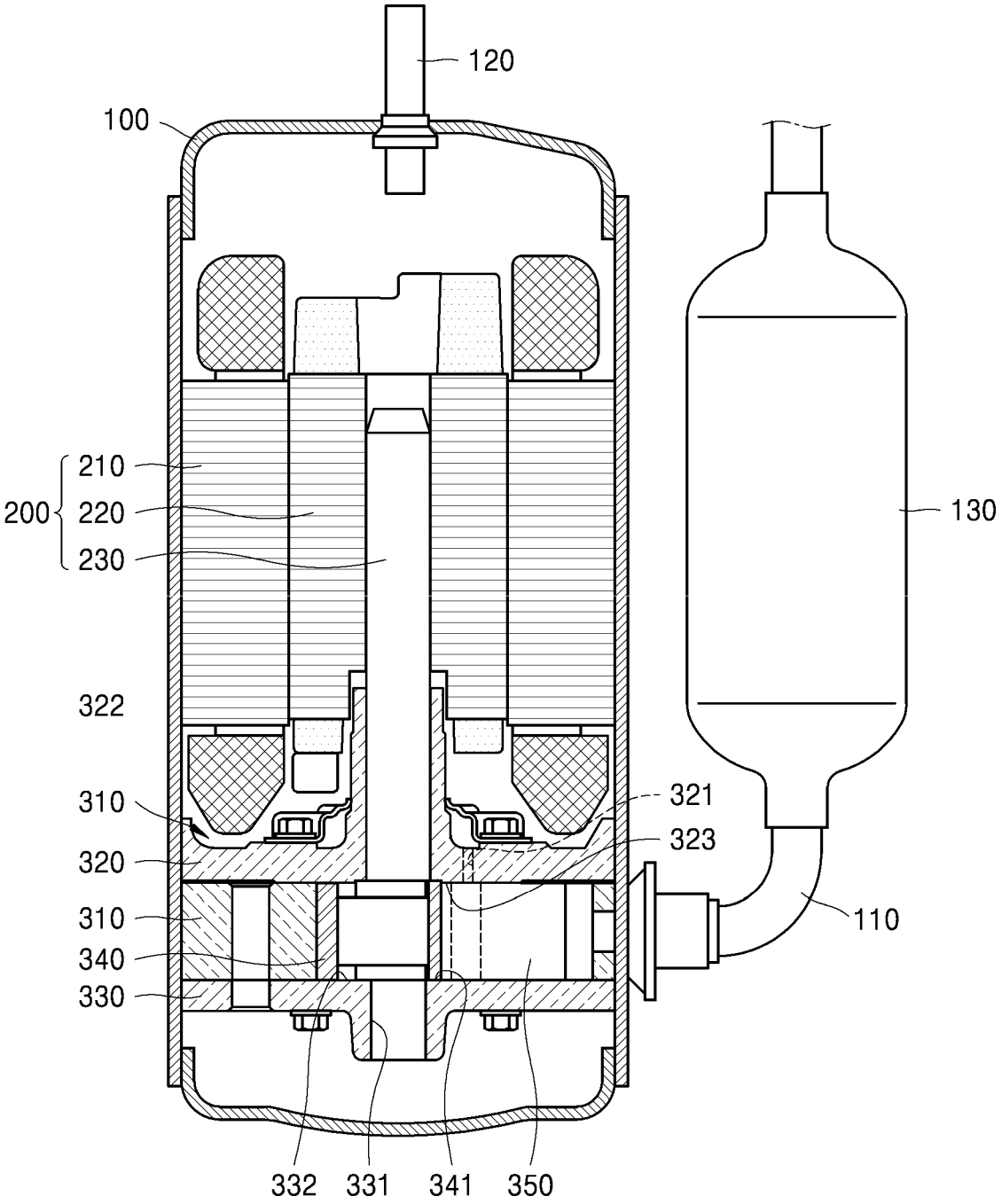
FIG. 3 is a cross-sectional view illustrating a rotary compressor according to an embodiment.
Figure 4:
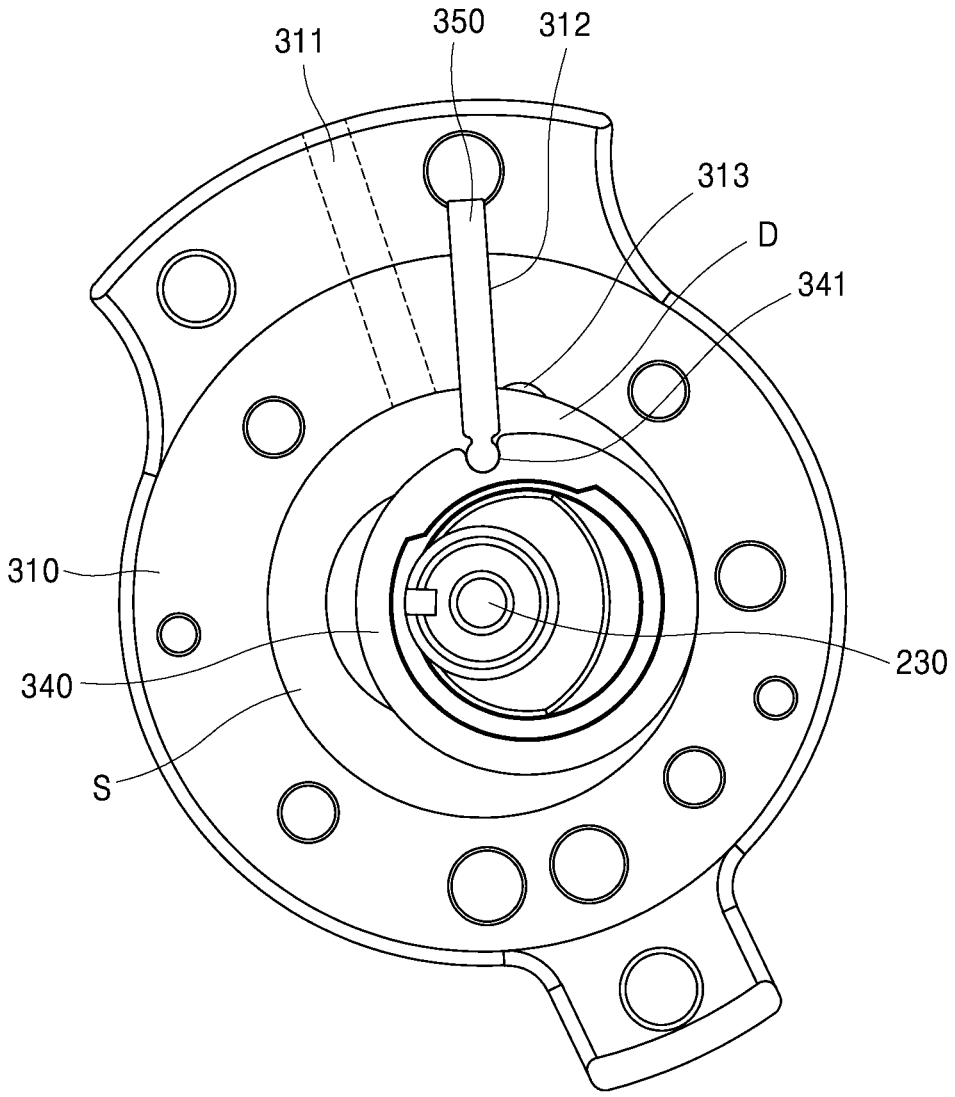
FIG. 4 is a view illustrating a compression portion of a rotary compressor according to an embodiment.

FIGS. 3 and 4 are respectively a cross-sectional view illustrating a rotary compressor according to an embodiment, and a view illustrating a compression portion 300 of a rotary compressor according to an embodiment.

Referring to FIGS. 3 and 4, for the rotary compressor, a transmission 200 and a compression portion 300 may be disposed together in an inner space of a sealed container 100.

The transmission 200 may comprise a stator 210 around which a coil is wound and which is fixedly installed in the sealed container 100, a rotor 220 rotatably disposed inside the stator 210, and a shaft 230 press-fitted to the rotor 220 and rotating along with the rotor.

The compression portion 300 may comprise a cylinder 310 having a ring shape, an upper bearing 320 (or a main bearing) disposed at an upper portion of the cylinder 310, a lower bearing 330 (or a sub bearing) configured to cover a lower side of the cylinder 310, a roller 340 rotatably coupled to an eccentric portion of the shaft 230, configured to contact an inner circumferential surface of the cylinder 310 and disposed in a compression chamber 314 of the cylinder 310, and a vane 350 coupled to the roller 340 and disposed to linearly reciprocate at a vane slot 312 disposed at the cylinder 310.

In the compression portion 300, a suction space (S) may be disposed at the left portion of the vane 350 in FIG. 4, and a discharge space (D) may be disposed at the right portion of the vane 350 in FIG. 4. Accordingly, the vane 350 may be couple to the roller and may divide the suction space (S) and the discharge space (D) physically and stably.

In this case, a suction port 311 for suctioning refrigerants may be disposed in a radial direction of the compression chamber 314 at one side of the cylinder 310. Additionally, the vane slot 312, into which the vane 350 is inserted, may be disposed at the cylinder 310. Further, a discharge port 321 for discharging refrigerants, compressed in the discharge space (D), to an inner space of the sealed container 100 may be disposed at one side of the upper bearing 320.

The shaft 230 may be disposed at a central portion of each of the upper bearing 320 and the lower bearing 330, and journal bearing surfaces 322, 331 may be disposed at the central portions to support the shaft 230 in a radial direction. Additionally, thrust surfaces 323, 332 may be disposed on surfaces, which are perpendicular to the journal bearing surfaces 322, 331 and which constitute the suction space (S) and the discharge space (D), to support the shaft 230, the roller 340 and the vane 350 in an axial direction of the shaft 230. Accordingly, both later surfaces of the vane 350 along with both lateral surface of the roller 340 may contact the upper bearing 320 and the lower bearing 330 with a gap (or a clearance) therebetween.

The rotary compressor with the above-described configuration is operated as follows.

When power is supplied to the stator 210 of the transmission 200, the rotor 220 may be rotated by a force generated by a magnetic field formed between the stator 210 and the rotor 220, and a rotational force may be delivered to the shaft 230 that passes through a center of the rotor 220. Accordingly, the roller 340 may make orbital movements by a distance at which the roller 340 rotatably coupled to the shaft 230 and disposed in the discharge space (D) of the cylinder 310 is eccentrically disposed relative to the shaft 230.

Because volume of the discharge space (D) may be reduced as the discharge space (D) is moved to a center by orbital movements of the roller 340. Accordingly, refrigerant gases may be suctioned into the suction space (S) physically divided by the vane 350 through the suction port 311 of a suction pipe 110. The suctioned refrigerant gases may be moved along a discharge hole 313 while being compressed by orbital movements of the roller 340, and then may be discharged to a discharge pipe 120 through the discharge port 321.

Figure 5:
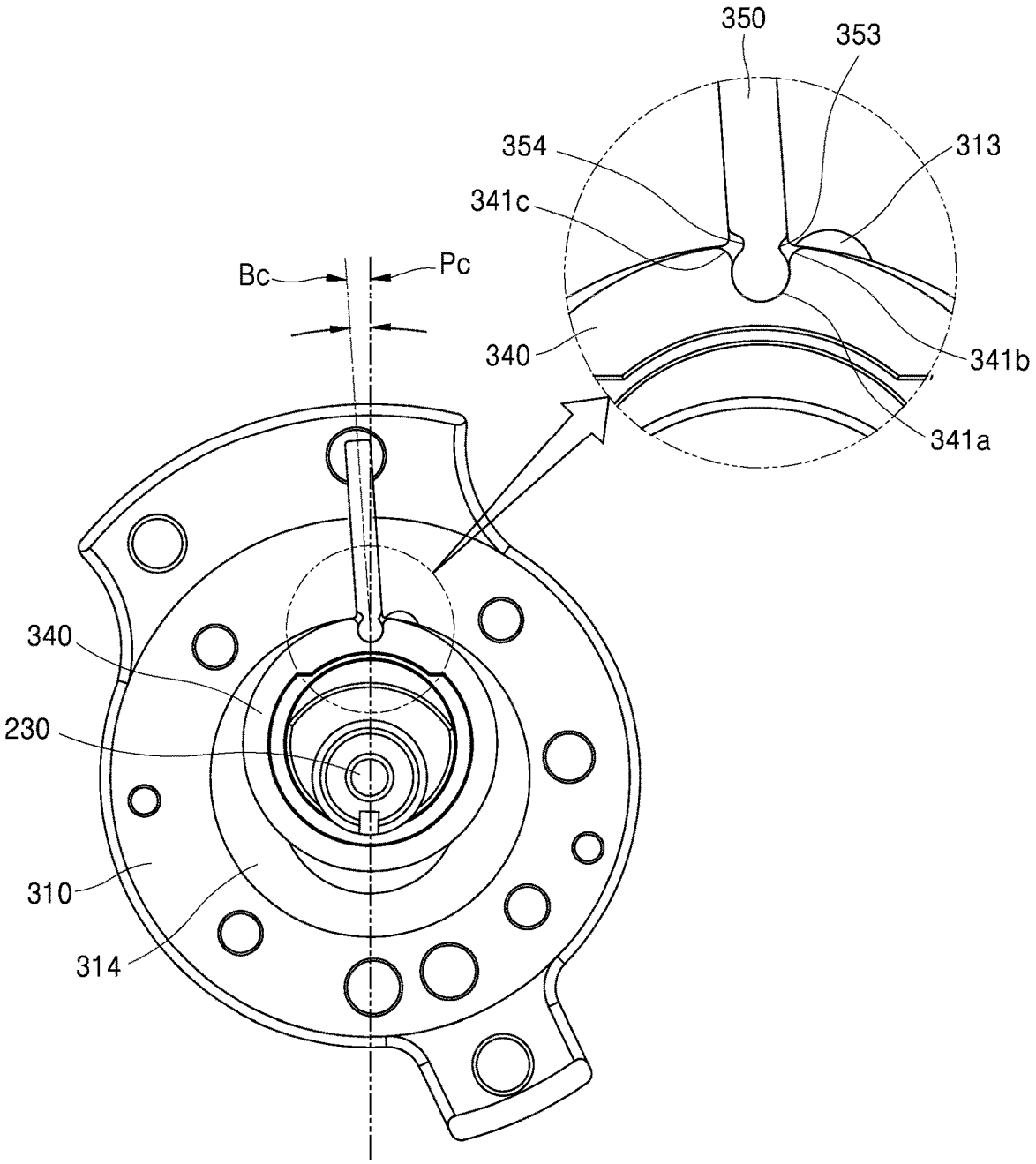
FIG. 5 is a view illustrating a compression portion of a rotary compressor according to an embodiment.
Figure 6:
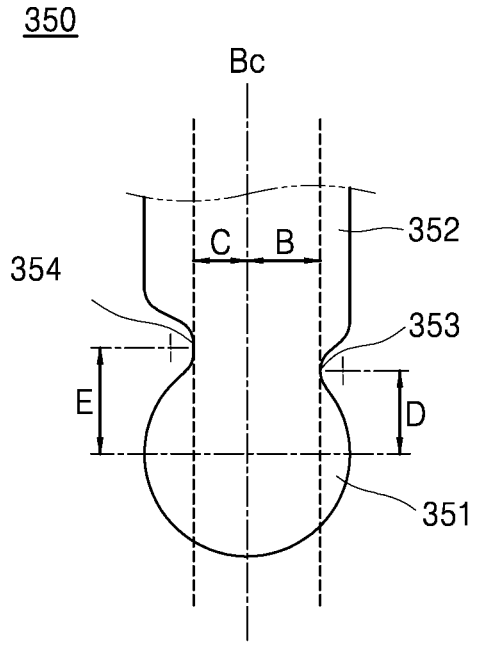
FIG. 6 is a view illustrating a vane of a rotary compressor according to an embodiment.

FIGS. 5 and 6 are respectively a view illustrating a compression portion of a rotary compressor according to an embodiment, and a view illustrating a vane of a rotary compressor according to an embodiment.

Detailed configurations of a compression portion 300 of the rotary compressor according to the present disclosure are described as follows with reference to FIGS. 5 and 6.

For the roller 340 that has a ring shape, an inner circumferential surface may be coupled to the shaft 230 to eccentrically rotate, and one side of an outer circumferential surface is provided with a coupling groove 341.

The coupling groove 341 may comprise a circumference portion 341*a*, and a discharge-sided circular arc portion 341*b* and a suction-sided circular arc portion 341*c* that are formed symmetrically on both sides of the circumference portion 341*a*.

For example, a center of the coupling groove 341 may be the same as a center of the circumference portion 341*a*.

Additionally, for the coupling groove 341, a central point of the circumference portion 341*a* may be disposed on the same line as a central point of the shaft 230.

That is, the center of the coupling groove 341 may be disposed at a central axis (Pc) of the compression chamber 314.

Further, a center of the compression chamber 314 and a center of the shaft 230 may be disposed on the same perpendicular line.

The vane 350 may comprise a vane hinge 351 coupled to the coupling groove 341, and a vane body 532 configured to divide the compression portion 300 into the discharge space (D) and the suction space (S).

The vane 350 may be provided with the vane hinge 351 corresponding to the circumference portion 341*a* of the coupling groove 341, and a discharge-sided groove 353 and a suction-sided groove 354 respectively at the discharge space (D) and the suction space (S) at a portion where the vane hinge 351 and the vane body 352 are coupled.

Accordingly, in the rotary compressor according to the present disclosure, a surface, where the vane hinge 351 contact the coupling groove 341, may vary depending on orbital movements of the roller 340.

As illustrated in FIG. 6, for the vane 350, the discharge-sided groove 353 and the suction-sided groove 354 may be formed asymmetrically with respect to a central axis (Bc) of the vane 350.

The central axis (Bc) of the vane 350 and the central axis (Pc) of the compression chamber 314 may be crossed at a point.

For the vane 350, volume of the discharge-sided groove 353 may be larger than that of the suction-sided groove 354 with respect to the central axis (Bc) of the vane 350, for example.

Figure 7:
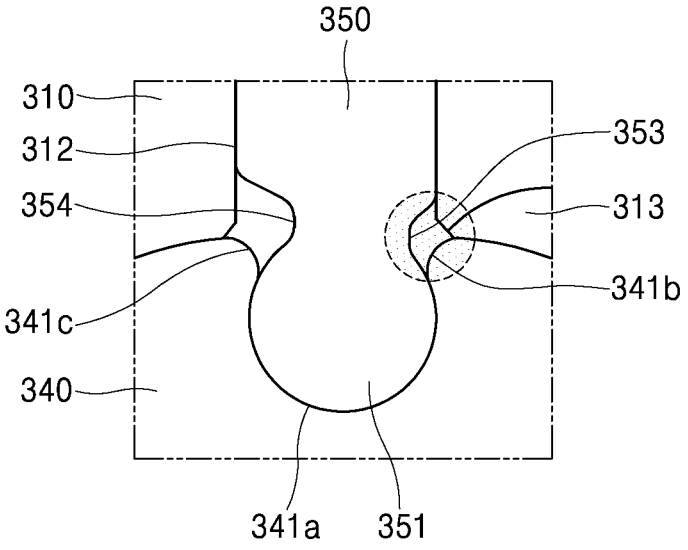
FIG. 7 is an enlarged view illustrating the concave portion in FIG. 5.

As a non-limited example, the discharge-sided groove 353 and the suction-sided groove 354 may respectively have a shape where a discharge side or a suction side of the vane body 352 is depressed to a degree where a part of a circle is depressed, as illustrated in FIG. 7.

In this case, for the grooves 353, 354, a radius of curvature of the circle that may determine the shapes of the grooves 353, 354 may be the same or may be different.

For example, a radius of curvature at the discharge-sided groove 353 may be smaller than a radius of curvature at the suction-sided groove 354. In this case, volume of a portion of the vane 350, where the discharge-sided groove 353 is disposed, may be larger than volume of a portion of the vane 350, where the suction-sided groove 354 is disposed.

As another example, a radius of curvature at the discharge-sided groove 353 and a radius of curvature at the suction-sided groove 354 may be substantially the same. Even in this case, when the depressed portion at the discharge lateral surface of the vane body 352 is smaller than the depressed portion at the suction lateral surface of the vane body 352, volume of the portion of the vane 350, where the discharge-sided groove 353 is disposed, may be larger than volume of the portion of the vane 350, where the suction-sided groove 354 is disposed.

In case the grooves 353, 354 have a predetermined radius of curvature respectively, shapes of the grooves 353, 354 may be determined by defining a center of each of the grooves.

The center of the discharge-sided groove 353 may denote a point formed at a shortest distance from the discharge-sided groove 353 to the central axis (Bc) of the vane 350, and the center of the suction-sided groove 354 may denote a point formed at a shortest distance from the suction-sided groove 354 to the central axis (Bc) of the vane 350.

However, the shapes of all the grooves 353, 354 may not have a predetermined radius of curvature. Curvature radii of the grooves 353, 354 may vary depending on their positions even in each of the grooves 353, 354.

For example, the suction-sided groove 354 and/or the discharge-sided groove 353 may be formed into a shape having a number of curvature radii. In this case, at least part of the suction-sided groove 354 and/or the discharge-sided groove 353 may have a substantially straight line shape rather than a curved shape.

In case each of the grooves 353, 354 has an inconsistent radius of curvature depending on their positions in each of the grooves 353, 354, the shapes of the grooves 353, 354 may not be determined only by the center of each of the grooves.

Accordingly, in the disclosure, the term "curved region" may be used to define the shapes of the grooves 353, 354. In the disclosure, the term may define an area having a curved shape literally. The curved shape may include not only a curved shape but also a curved shape which is locally formed into a straight line but substantially or wholly formed into a curved.

Accordingly, unlike the center of the discharge-sided groove 353 or the center of the suction-sided groove 354, the curved region of the discharge-sided groove 353 or the suction-sided groove 354 may denote whole shapes of the lines of the discharge-sided groove 353 or the suction-sided groove 354 rather than a single point, with reference to FIG. 6.

For the vane 350, a distance (B) from the central axis (Bc) of the vane 350 to the center of the discharge-sided groove 353 may be longer than a distance (C) from the central axis (Bc) of the vane 350 to the center of the suction-sided groove 354.

A diameter of the vane hinge 351 may be the same as a distance between both lateral surfaces of the vane body 352.

The central axis (Bc) of the vane 350 may pass a center of the vane hinge 351.

Accordingly, for the vane 350, a distance between the center of the discharge-sided groove 353 and a lateral surface of the discharge space (D) of the vane body 352 may be shorter than a distance between the center of the suction-sided groove 354 and a lateral surface of the suction space (S) of the vane body 352.

Additionally, for the vane 350, a distance (D) from a straight line, passing the center of the vane hinge 351 and perpendicularly crossing the central axis (Bc) of the vane 350, to the center of the discharge-sided groove 353 may be shorter than a distance (E) from the straight line to the center of the suction-sided groove 354.

For the vane 350, a distance (B) from the central axis (Bc) of the vane 350 to the curved region (B) of the discharge-sided groove 353 may be longer than a distance (C) from the central axis (Bc) of the vane 350 to the curved region (C) of the suction-sided groove 354.

For the vane 350, a distance (D) from a straight line, passing the center of the vane hinge 351 and perpendicularly crossing the central axis (Bc) of the vane 350, to the curved region (D) of the discharge-sided groove 353 may be shorter than a distance (E) from the straight line to the curved region (E) of the suction-sided groove 354.

Further, a longest distance between the vane hinge 351 and the vane body 352 at the suction-sided groove 354 may be longer than a longest distance between the vane hinge 351 and the vane body 352 at the discharge-sided groove 353 with respect to a length-wise direction of the vane 350.

Furthermore, a depth from a suction-sided lateral surface of the vane body 352 to the suction-sided groove 354 may be deeper than a depth from a discharge-sided lateral surface of the vane body 352 to the discharge-sided groove 353.

For the vane slot 312, a central axis of the vane slot 312 may be inclined towards the suction space (S) with respect to the center of the coupling groove 341 at a predetermined angle.

The central axis of the vane slot 312, as illustrated in FIG. 5, may be inclined further toward the suction space (S) than toward the central axis (Pc) of the compression chamber 314 with respect to the center of the coupling groove 341 at a predetermined angle.

Accordingly, the vane 350 coupled to the coupling groove 341 may be inserted into the vane slot 312 such that interference caused by the shape of the discharge-sided groove 353 may be prevented when the vane 350 moves back and forth because of orbital movements of the roller 340.

That is, to prevent interference between a portion, extending from the discharge-sided groove 353 of the vane 350 towards the vane body 352, and the discharge-sided circular arc portion 341*b*, the central axis of the vane slot 312 may be inclined towards the suction space (S) at an angle of 2 to 10° with respect to the center of the coupling groove 341.

The central axis of the vane slot 312 may be the same as the central axis (Bc) of the vane 350.

Accordingly, the central axis (Bc) of the vane 350 and the central axis (Pc) of the compression chamber 314 may be crossed at a central point of the coupling groove 341, and an angle formed between the central axis (Bc) of the vane 350 and the central axis (Pc) of the compression chamber 314 may be 2 to 10°.

Thus, in the rotary compressor according to the present disclosure, as a central axis of orbital movements of the roller 340 and the central axis (Bc) of the vane 350 are aligned, a rotational force load, applied to the vane 350 by the orbital movements of the roller 340, may be reduced.

FIG. 7 is a view showing results of comparison between dead volume of a combined rotary compressor of the related art and dead volume of the rotary compressor according to the present disclosure.

In a rotary compressor, dead volume may denote a space formed near the discharge space (D) among a vane 350, a roller 340 and a vane slot 312.

Dead volume may be a cause for loss of cooling capability as remaining refrigerant gases flow into the suction space (S) because of orbital movements of the roller 340 in a state where the vane 350 moves towards an outer circumferential surface of the cylinder 310 as close as possible (i.e., a state where the vane 350 is at a top dead point).

Referring to FIG. 7, for the vane 350 of the rotary compressor according to the present disclosure, the discharge-sided groove 353 and the suction-sided groove 354 may be asymmetrically formed to reduce dead volume.

In the state where the vane 350 comes closest to the outer circumferential surface of the cylinder 310 (i.e., a top dead point of the vane 350), volume of a space, formed among the discharge-sided groove 353, the discharge-sided circular arc portion 341*b* and the cylinder 310, may be smaller than volume of a space formed among the suction-sided groove 354, the suction-sided circular arc portion 341*c* and the cylinder 310.

As a result, unlike a rotary compressor provide with a symmetrical vane of the related art, the rotary compressor, provided with an asymmetrical vane of the present disclosure with respect to the top dead point of the vane 350, may greatly reduce volume of a space formed among the discharge-sided groove 353, the discharge-sided circular arc portion 341*b* and the vane slot 312.

When the vane 350 is at the top dead point, volume of a space, formed among the discharge-sided groove 353, the discharge-sided circular arc portion 341*b* and the cylinder 310, may be 30 to 80% of volume of a space formed among the suction-sided groove 354, the suction-sided circular arc portion 341*c* and the cylinder 310.

Accordingly, under the assumption that dead volume of the combined rotary compressor of the related art is 100%, dead volume of the rotary compressor according to the present disclosure may be 20 to 70% lower than that of the rotary compressor of the related art thanks to the shape of the above-described discharge-sided groove 353.

Additionally, the cylinder 310 may comprise a suction port 311 formed at one side of the suction space (S) and a discharge hole 313 formed at one side of the discharge space (D).

The cylinder 310 may communicate with a space formed among the discharge-sided groove 353, the discharge-sided circular arc portion 341*b* and the cylinder 310 when the vane 350 is at the top dead point.

Accordingly, the rotary compressor according to the present disclosure may discharge compressed refrigerant gases in a state where refrigerants are compressed as much as possible in the compression chamber 314, thereby ensuring improved cooling capabilities of the rotary compressor.

Figure 8:
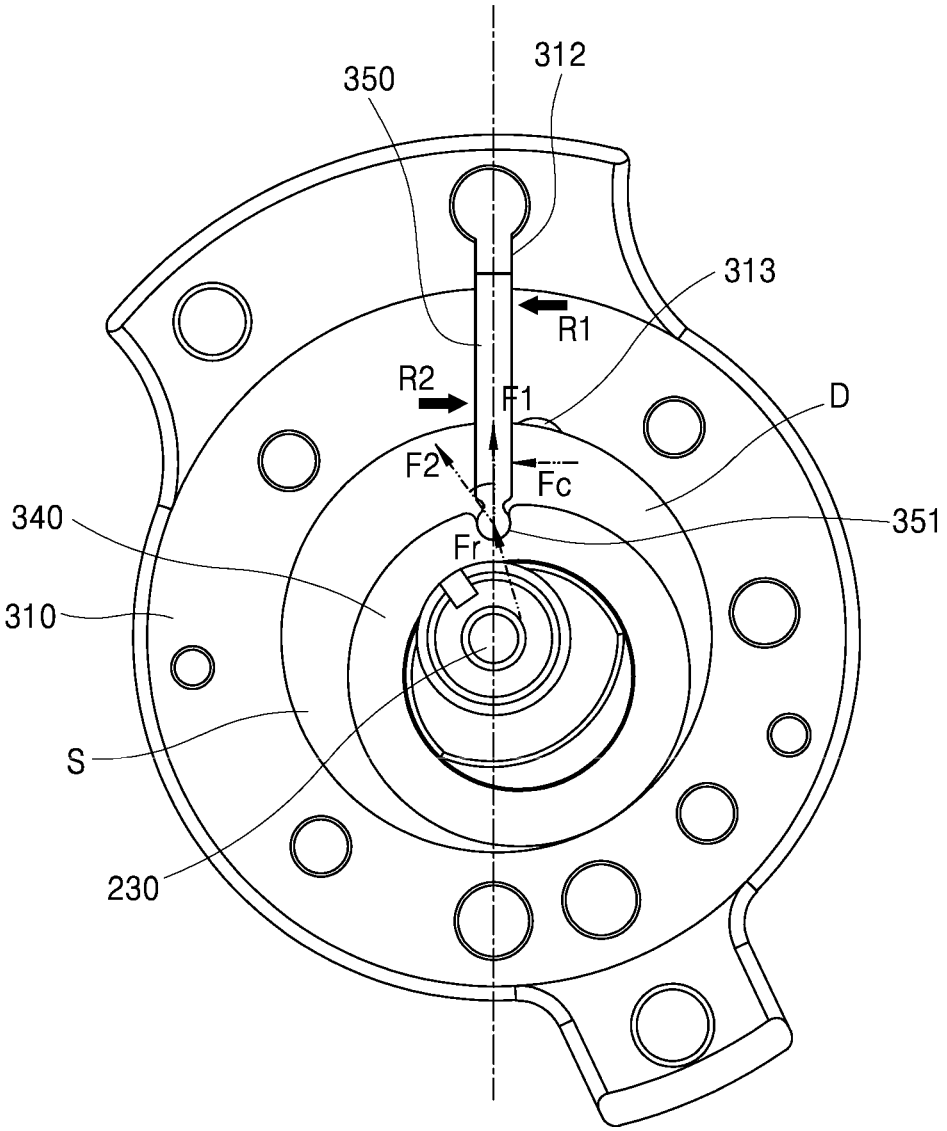
FIG. 8 PRIOR ART
FIG. 8 is a view illustrating a compression portion of a combined rotary compressor of the related art.
Figure 9:
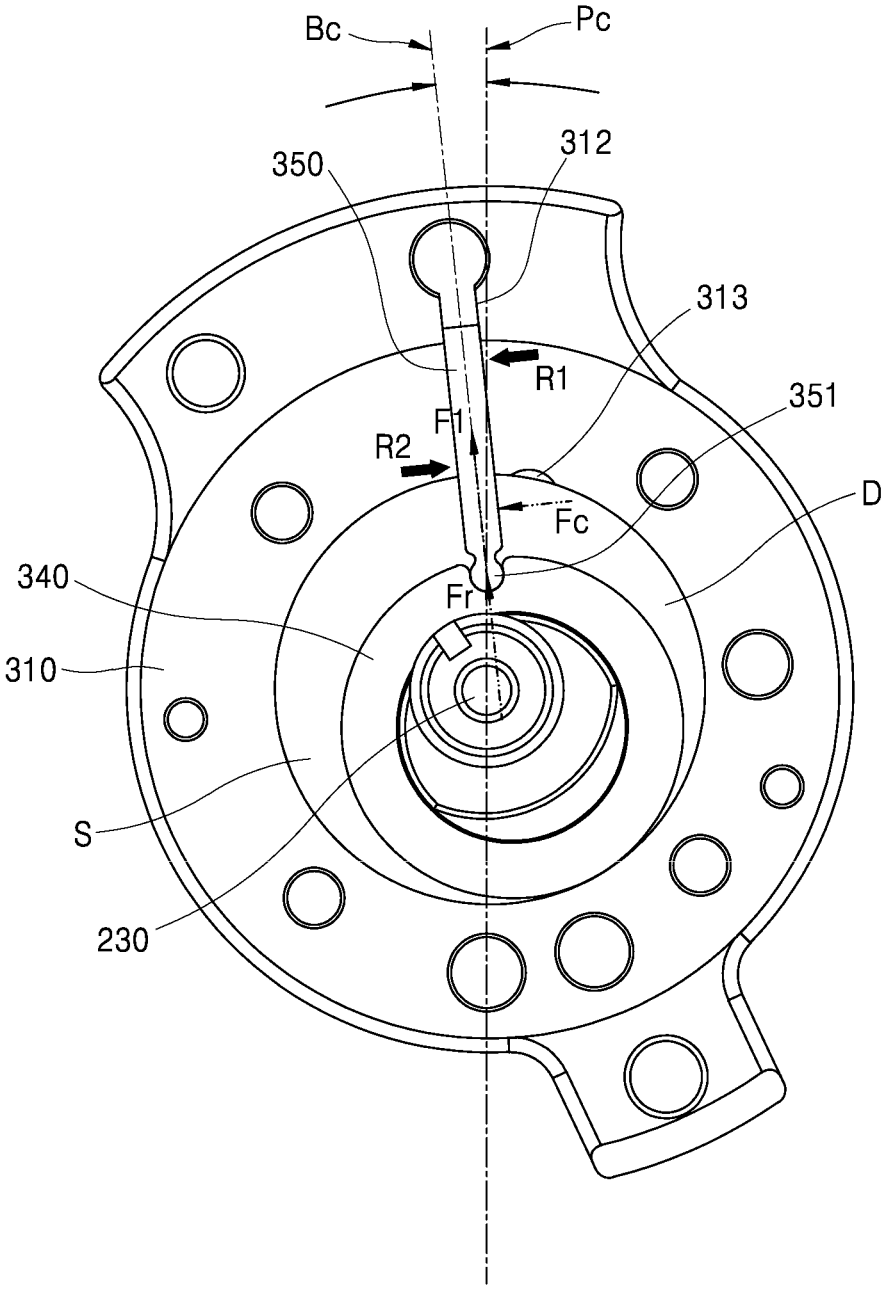
FIG. 9 is a view illustrating a compression portion of a rotary compressor according to an embodiment.

FIG. 8 is a view illustrating a compression portion of a combined rotary compressor of the related art, and FIG. 9 is a view illustrating a compression portion of a rotary compressor according to an embodiment.

Specifically, FIG. 8 is a view illustrating a compression portion of a rotary compressor of the related art where a central axis of a vane slot 312 is disposed on a straight line that passes a center of a shaft 230 and a center of a coupling groove 341.

Referring to FIG. 8, in case a force (Fr), applied to a front end of the vane 350 (i.e., the vane hinge 351) in the rotary compressor of the related art, is divided into a force (F1) applied from the front end of the vane 350 to a rear end of the vane 350 and a force (F2) applied from the front end of the vane 350 to a direction of rotation of the roller 340, a shearing force may be applied to the front end of the vane 350.

Referring to FIG. 9, in the rotary compressor according to the present disclosure, the central axis of the vane slot 312 may be inclined towards the suction space (S) at a predetermine angle relative to a straight line passing the center of the shaft 230 and the coupling groove 341 with respect to the center of the coupling groove 341. As a result, the force (F1) applied from the front end of the vane 350 to the rear end of the vane 350 may only exist as a force (Fr) applied to the front end of the vane 350. Accordingly, a shearing force may not be applied to the front end of the vane 350.

Thus, the rotary compressor according to the present disclosure, having the vane 350 where the shapes of the discharge-sided groove 353 and the suction-sided groove 354 are asymmetrical, may ensure improvement in durability of the vane 350.

Figure 10:
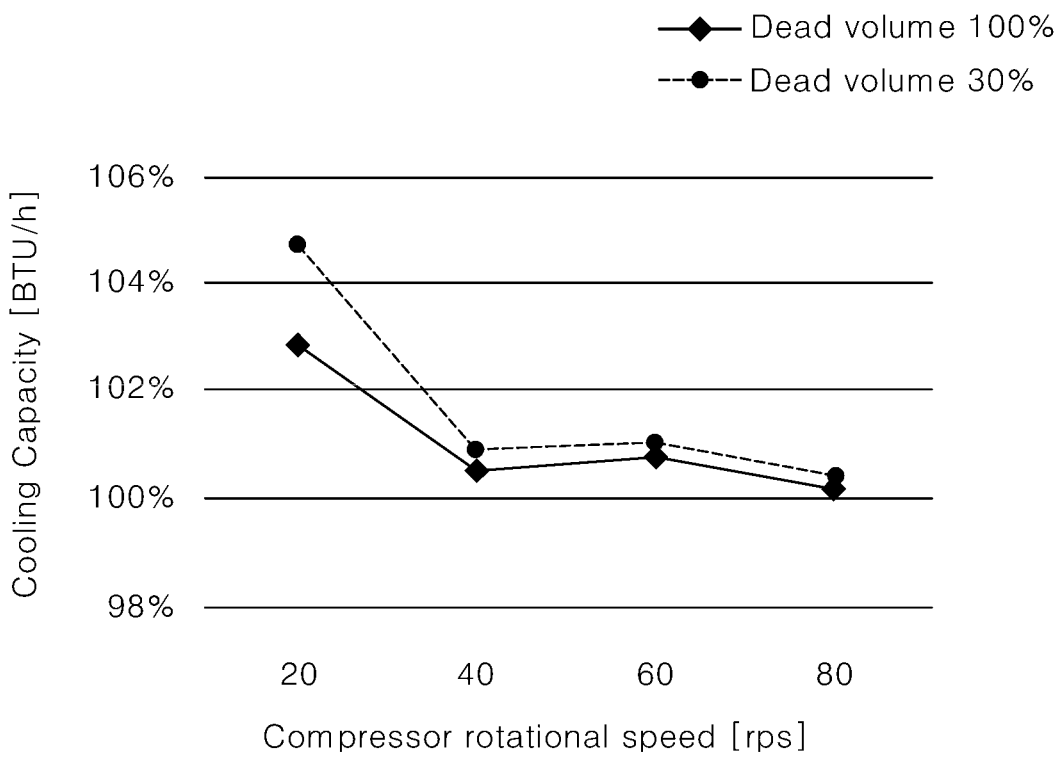
FIG. 10 is a graph showing a result of comparison of cooling capabilities based on a speed of rotation of a shaft when dead volume in a combined compressor is respectively 100% and 30%.
Figure 11:
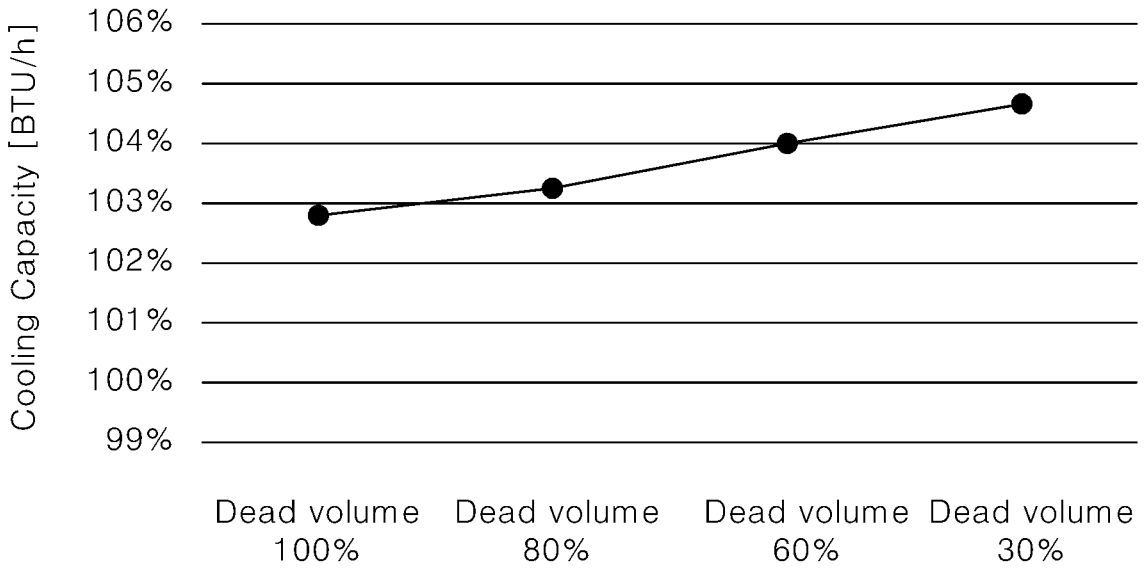
FIG. 11 is a graph showing a change in cooling capabilities based on a change in dead volume in a combined compressor.

FIG. 10 is a graph showing a result of comparison of cooling capabilities based on a speed of rotation of a shaft when dead volume in a combined compressor is respectively 100% and 30%, and FIG. 11 is a graph showing a change in cooling capabilities (BTU/h, British thermal unit per hour) based on a change in dead volume in a combined compressor.

In this case, cooling capabilities may be a relative value under the assumption that cooling capability of a non-combined rotary compressor, where a roller may self-rotate, is 100%.

Referring to FIG. 10, when a speed (rps, revolutions per second) of rotation of a crank shaft is low, the rotary compressor according to the present disclosure (30% of dead volume relative to 100% of dead volume of the combined rotary compressor of the related art) has cooling efficiency 4 to 6% higher than the non-combined rotary compressor, while the combined rotary compressor of the related art (100% of dead volume) has cooling efficiency 2 to 4% higher than the non-combined rotary compressor.

Further, referring to FIG. 11, as dead volume may be reduced from 100% to 30% in the combined rotary compressor, cooling capability continues to improve.

When the shaft 230 rotates at low speed, the rotary compressor according to the present disclosure may have cooling capability 1.8% higher than the rotary compressor of the related art thanks to the vane 350 where the shapes of the discharge-sided groove 353 and the suction-sided groove 354 are asymmetrical.

Thus, the rotary compressor according to the present disclosure may minimize loss of cooling capability caused by over compression thanks to the shape that helps reduce dead volume at the discharge space (D), thereby ensuring improvement in cooling capability.

Figure 12:
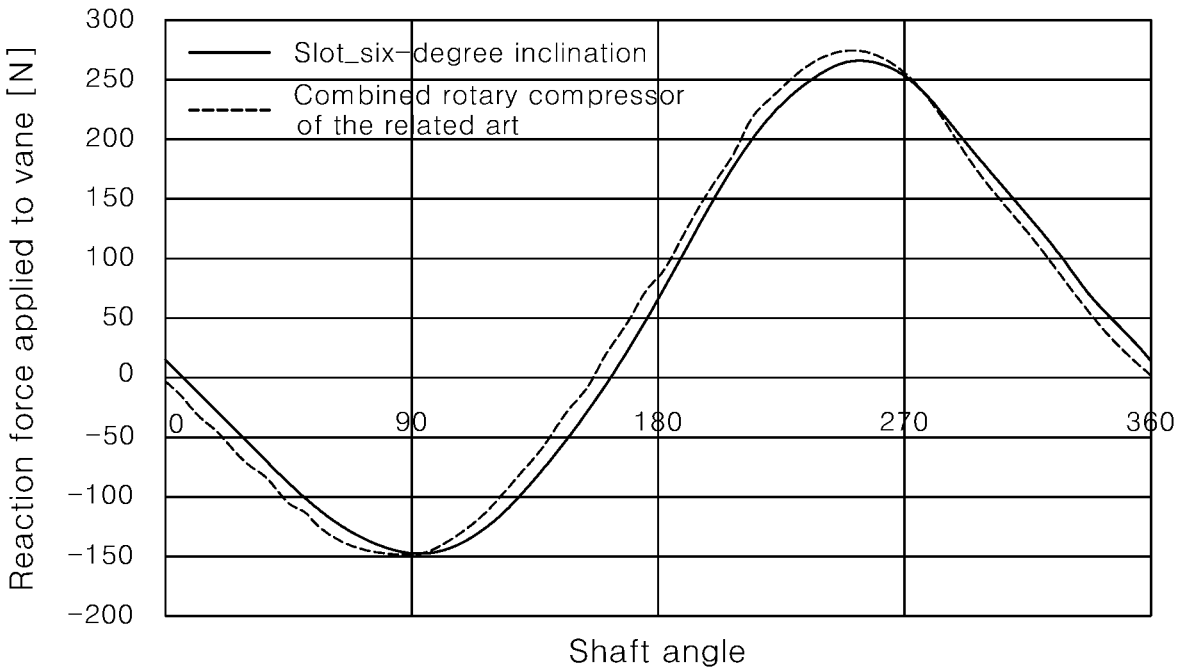
FIG. 12 is a graph showing a result of comparison of reaction forces applied to a vane in a compression chamber, based on an inclination of a vane slot in a combined rotary compressor of the related art and in a rotary compressor according to the present disclosure.

FIG. 12 is a graph showing a result of comparison of reaction forces applied to a vane in a compression chamber 314, based on an angle of a shaft in a combined rotary compressor of the related art and in a combined rotary compressor according to the present disclosure where a vane slot is inclined.

Referring to FIG. 12, in the rotary compressor of the related art, where the central axis of the vane slot 312 is on a straight line passing the center of the shaft 230 and the center of the coupling groove 341, a maximum reaction force applied to the vane 350 in the compression chamber 314 is 272N.

In the rotary compressor according to the present disclosure, where the central axis of the vane slot 312 is inclined towards the suction space (S) at an angle of 6° relative to the straight line passing the center of the shaft 230 and the coupling groove 341 with respect to the center of the coupling groove 341, a maximum reaction force applied to the vane 350 in the compression chamber 314 is 264N.

In the rotary compressor according to the present disclosure, where the vane slot 312 is inclined towards the suction space (S) at an angle of 6° with respect to the center of the coupling groove 341, a maximum reaction force applied to the vane 350 in the compression chamber 314 may be 3% lower than in the rotary compressor of the related art, which includes the same components as the rotary compressor according to the present disclosure except the vane slot 312 inclined as described above.

Thus, in the rotary compressor according to the present disclosure, the vane slot 312 may be inclined towards the suction space (S) with respect to the center of the coupling groove 341, thereby making it possible to minimize a load applied to the vane 350 and improve durability of the vane 350.

The present disclosure has been described with reference to the embodiments illustrated in the drawings. However, the disclosure is not limited to the embodiments and the drawings set forth herein. Additionally, various modifications may be made by one having ordinary skill in the art within the scope of the technical spirit of the disclosure. Further, though not explicitly described during the description of the embodiments of the disclosure, effects and predictable effects based on the configuration of the disclosure should be included in the scope of the disclosure.

DESCRIPTION OF THE SYMBOLS

Bc. Central axis of vane
Pc. Central axis of compression chamber
100. Sealed container
110. Suction pipe
120. Discharge pipe
200. Transmission
210. Stator
220. Rotor
230. Shaft
300. Compression portion
310. Cylinder
311. Suction port
312. Vane slot
313. Discharge hole
314. Compression chamber
320. Upper bearing
321. Discharge port
322. Journal bearing surface
323. Thrust surface
330. Lower bearing
331. Journal bearing surface
332. Thrust surface
340. Roller
341. Coupling groove
341*a*. Circumference portion
341*b*. Discharge-sided circular arc portion
341*c*. Suction-sided circular arc portion
350. Vane
351. Vane hinge
352. Vane body
353. Discharge-sided groove
354. Suction-sided groove
D. Discharge space
S. Suction space

The invention claimed is:

1. A rotary compressor comprising:

a cylinder that includes a vane slot and that defines a compression chamber;

a shaft that includes an eccentric portion and that extends through a center of the compression chamber;

a roller that includes a coupling groove and that is configured to orbit in the compression chamber based on rotation of the shaft; and a vane that includes a vane hinge and a vane body, the vane hinge being configured to engage with the coupling groove and the vane body being at least partially inserted into the vane slot to divide the compression chamber into a discharge space and a suction space, wherein the vane includes a discharge-sided groove and a suction-sided groove that are disposed between the vane hinge and the vane body and that are opposite to each other with respect to a central axis of the vane, the discharge-sided groove being closer to the discharge space than the suction-sided groove, and the suction-sided groove being closer to the suction space than the discharge-sided groove, wherein a central point of the coupling groove and a central axis of the vane slot are on a single straight line, and wherein a shape of the discharge-sided groove is asymmetrical to a shape of the suction-sided groove with respect to the central axis of the vane.

2. The rotary compressor of claim 1, wherein the center of the compression chamber is aligned with a center of the shaft.

3. The rotary compressor of claim 1, wherein the coupling groove comprises a circumference portion, a discharge-sided circular arc portion, and a suction-sided circular arc portion, the discharge-side circular arc portion being symmetrical to the suction-sided circular arc portion with respect to a straight line that extends through a center of the circumference portion and the center of the compression chamber.

4. The rotary compressor of claim 3, wherein, based on the vane being at a top dead point, a first space that is defined by the discharge-sided groove of the vane, the discharge-sided circular arc portion of the coupling groove, and the cylinder is smaller than a second space that is defined by the suction-sided groove of the vane, the suction-sided circular arc portion of the coupling groove, and the cylinder.

5. The rotary compressor of claim 4, wherein a volume of the first space is 30 to 80% of a volume of the second space.

6. The rotary compressor of claim 1, wherein a central axis of the vane slot inclines towards the suction space with respect to a first straight line that extends through a center of the coupling groove and the center of the compression chamber.

7. The rotary compressor of claim 6, wherein the central axis of the vane slot crosses the first straight line.

8. The rotary compressor of claim 6, wherein the central axis of the vane slot crosses the first straight line at the center of the coupling groove.

9. The rotary compressor of claim 6, wherein an angle between the central axis of the vane slot and the first straight line is within a range of 2° to 10°.

10. The rotary compressor of claim 1, wherein a central axis of the vane slot is aligned to the central axis of the vane.

11. The rotary compressor of claim 1, wherein a center of the vane hinge is aligned to a center of the coupling groove.

12. The rotary compressor of claim 1, wherein a diameter of the vane hinge is the same as a distance between opposite lateral surfaces of the vane body.

13. The rotary compressor of claim 1, wherein the central axis of the vane extends through a center of the vane hinge.

14. The rotary compressor of claim 1, wherein a radius of curvature of the discharge-sided groove is smaller than a radius of curvature of the suction-sided groove.

15. The rotary compressor of claim 1, wherein a distance between the central axis of the vane and a center of the discharge-sided groove is greater than a distance between the central axis of the vane and a center of the suction-sided groove.

16. The rotary compressor of claim 1, wherein a distance from a first straight line that extends through a center of the vane hinge and is perpendicular to the central axis of the vane to a second straight line that extends through a center of the discharge-sided groove and is perpendicular to the central axis of the vane is shorter than a distance from the first straight line to a third straight line that extends through a center of the suction-sided groove and is perpendicular to the central axis of the vane.

17. The rotary compressor of claim 1, wherein the cylinder comprises (i) a suction port that is defined at a side of the suction space, and (ii) a discharge hole that is defined at a side of the discharge space.

18. The rotary compressor of claim 17, wherein the discharge hole is configured to, based on the vane being at a top dead point, fluidly communicate with a space that is defined by the discharge-sided groove of the vane, the discharge-sided circular arc portion of the coupling groove, and the cylinder.

19. The rotary compressor of claim 1, wherein a longest distance between the vane hinge and the vane body at the suction-sided groove along the central axis of the vane is greater than a longest distance between the vane hinge and the vane body at the discharge-sided groove along the central axis of the vane.

20. The rotary compressor of claim 1, wherein a depth from a suction-sided lateral surface of the vane body to the suction-sided groove is greater than a depth from a discharge-sided lateral surface of the vane body to the discharge-sided groove, the discharge-sided lateral surface being opposite to the suction-sided lateral surface with respect to the central axis of the vane.

* * * * *